US008308531B2

(12) United States Patent
Kim et al.

(10) Patent No.: US 8,308,531 B2
(45) Date of Patent: Nov. 13, 2012

(54) POLISHING PAD AND METHOD OF MANUFACTURING THE SAME

(75) Inventors: Won-Joon Kim, Gumi-si (KR); Yeong-Nam Hwang, Gumi-si (KR)

(73) Assignee: Kolon Industries, Inc., Kwacheon-si (KR)

( * ) Notice: Subject to any disclaimer, the term of this patent is extended or adjusted under 35 U.S.C. 154(b) by 515 days.

(21) Appl. No.: 12/663,155

(22) PCT Filed: Jun. 28, 2008

(86) PCT No.: PCT/KR2008/003747

§ 371 (c)(1), (2), (4) Date: Dec. 4, 2009

(87) PCT Pub. No.: WO2009/002124

PCT Pub. Date: Dec. 31, 2008

(65) Prior Publication Data

US 2010/0173573 A1 Jul. 8, 2010

(30) Foreign Application Priority Data

Jun. 27, 2007 (KR) ..... 10-2007-0063370
Aug. 24, 2007 (KR) ..... 10-2007-0085236

(51) Int. Cl.
*B24D 11/00* (2006.01)

(52) U.S. Cl. ..... 451/532; 451/526

(58) Field of Classification Search ..... 451/526, 451/532
See application file for complete search history.

(56) References Cited

U.S. PATENT DOCUMENTS

2002/0013984 A1 2/2002 Makiyama et al.

FOREIGN PATENT DOCUMENTS

| | | | |
|---|---|---|---|
| JP | 9-59395 | A | 3/1997 |
| JP | 2002-79472 | A | 3/2002 |
| JP | 2005-74609 | A | 3/2005 |
| KR | 1989-0000808 | B1 | 4/1989 |

*Primary Examiner* — Maurina Rachuba
(74) *Attorney, Agent, or Firm* — Birch, Stewart, Kolasch & Birch, LLP

(57) ABSTRACT

Disclosed are a polishing pad used in a CMP process of a planar material such as a silicon wafer, plate glass for a display, etc. and a method for manufacturing the same. The polishing pad comprises a non-woven fabric consisting of ultrafine fibers and elastomeric polymer impregnated into the fabric, on which the ultrafine fibers are raised and arranged to simultaneously satisfy the following conditions (I) to (III) such that the ultrafine fibers are oriented in a longitudinal direction to a central axis:

The polishing pad of the present invention includes ultrafine fibers, which are arranged at a relatively wide orientation angle and have pores formed therebetween without requiring alternative processes for forming the pores, thus, exhibits excellent polishing performance and low occurrence of scratches during a polishing process.

6 Claims, 1 Drawing Sheet

POLISHING PAD AND METHOD OF MANUFACTURING THE SAME

TECHNICAL FIELD

The present invention relates to a polishing pad which is effectively employed in chemical mechanical polishing (hereinafter referred to as "CMP") processes and, more specifically, CMP planarization of planar materials such as silicon wafers for integrated circuit chips or the like, plate glass for displays or other substrates and, in addition, which is preferably applied in texture processing of a magnetic recording medium that requires high accuracy surface finishing treatment, as well as a method of manufacturing the same.

BACKGROUND ART

Silicon wafers are generally processed or polished using a CMP apparatus, which includes a lower board having a circular rotational plate equipped with a polishing pad, an upper board to closely adhere a silicon wafer to the polishing pad, and a device to feed slurry on the polishing pad.

A CMP process includes pushing a semiconductor wafer, on which an integrated circuit is formed, in an opposite direction to a driven polishing pad such that oxides including Si based deposits are removed from the wafer, and producing a planar surface with high smoothness on the wafer. During the CMP process, the wafer and an interface of the polishing pad is coated with deionized water and/or a chemically active reagent as well as a polishing solution.

Recently, a magnetic recording medium such as a magnetic disk is demanded to increase capacity and/or memory density according to advanced technology innovations and, therefore, there is a requirement for development of high density integration of substrates during surface processing.

According to increased capacity and/or memory density, a gap between a recording disk and a magnetic head, that is, a fly height of the magnetic head is reduced. Due to considerably decreased fly height, if a protrusion formed on a surface of a magnetic recording disk, the protrusion may contact a magnetic head to cause head crash, resulting in damage to the surface of the magnetic disk. Also, even with a microfine protrusion substantially not causing the head crash, it may contact the magnetic head and possibly cause malfunction in reading and writing information. Additionally, because of the protrusion, the magnetic head may be in close contact with the surface of the disk, causing a problem of not allowing the magnetic head to fly properly.

In order to prevent such a close contact between the recording disk and the magnetic head, surface treatment such as a texturing process is generally carried out to give microfine streaks on the surface of a substrate used in a recording disk. Such a texturing process controls orientation of crystal growth when a metal magnetic layer is formed on the substrate of the recording disk, so that the recording disk has increased coercive force in a recording direction thereon, which in turn, results in improved recording density of the recording disk.

As an example of the texturing process, a slurry polishing method using a polishing pad applied with a slurry of glass grinding stone particles has been used.

For instance, a method for manufacturing a magnetic recording substrate of a hard disk often used as a magnetic recording medium generally comprises a smoothing processing or planarization (hereinafter referred to as "planarization") to prepare a planar surface of aluminum, glass, etc., treating the planar surface by non-magnetic plating such as a nickel phosphorous coating, forming a magnetic thin layer made of cobalt based alloys, and coating the magnetic thin layer with a surface protective layer made of carbon materials to produce the substrate.

In recent years, there is an increased requirement for polishing pads used in planarization of a magnetic recording substrate. Especially, the final step of the planarization often includes surface treatment called a "texturing process", which uses slurry containing abrasive particles dispersed therein and a polishing pad so as to form microfine trenches on a surface of a recording disk. Accordingly, there remains a need for development of an optimal polishing pad to embody high capacity and/or memory density magnetic disks.

Conventional CMP processes using polishing pads have been disclosed, in particular, Japanese Patent Laid-Open No. 2005-329491 disclosed a polishing pad with structure of a pad A and an elastomeric polymer coating layer B placed on the pad A, wherein the pad A comprises a non-woven fabric consisting of nylon staple fibers with 1 to 5 denier and is prepared by impregnating the fabric with the same elastomeric polymer as used in the coating layer B, especially, polyurethane resin, as shown in FIG. 4.

However, this polishing pad was manufactured by preparing the pad A through impregnation of the non-woven fabric with polyurethane resin and, then, applying the same polyurethane resin to the pad A to form a coating layer. For this reason, the polishing pad described above needs composite processes and encounters a problem that it is difficult to uniformly control a size of pores in the coating layer B.

Furthermore, when the coating layer B is completely worn out, the polishing pad cannot be used any more even though the pad A under the coating layer B remains unchanged or unworn. Therefore, this has problems of short product life and/or causing a great amount of waste of raw materials.

Japanese Patent Laid-Open No. H9-59395 proposed a polishing pad which comprises a non-woven fabric consisting of synthetic staple fibers with 1 to 5 denier and is prepared by impregnating the fabric with polyurethane resin. However, since the synthetic staple fiber has high monofilament fineness and, thus, high modulus, the staple fibers arranged on a surface of the polishing pad have an increased orientation angle of 30 to 50°, which is an angle of the fiber to the polishing pad in a longitudinal direction thereof.

Such a polishing pad described above exhibits an irregular surface and has thick staple fibers arranged on the surface of the pad, thereby causing a lack of pores between the fibers and a decrease in polishing performance of the pad.

Further, Japanese Patent Laid-Open Nos. 2005-074609 and 2001-67659 disclosed a polishing pad for a magnetic recording medium which comprises (i) a non-woven fabric made of ultrafine fibers and (ii) elastomeric polymer impregnated into the non-woven fabric, and in which the ultrafine fibers are arranged and raised on a surface of the polishing pad.

However, the ultrafine fibers arranged on the surface of the polishing pad are too much parallel in the longitudinal direction of the pad, that is, have a very small orientation angle $\theta_2$, as well as a fiber raising angle $\theta_1$ of the ultrafine fibers raised on the surface thereof so small that a binding force between bundles of ultrafine fibers is excessively high to deter slurry particles from smoothly flowing during the texturing process, resulting in agglomeration of the particles. Therefore, the polishing pad disclosed in the above patent has disadvantages of reduced polishing performance and many scratches occurring on a polished surface of a magnetic recording medium.

DISCLOSURE

Technical Problem

Accordingly, the present invention is directed to solve the problems described above in regard to conventional methods and an object of the present invention is to provide a polishing pad with excellent polishing performance and low occurrence of scratches during the polishing process, which comprises ultrafine fibers arranged on a surface of the polishing pad at a relatively wide range of orientation angle $\theta_2$ to render uniformity to the surface of the pad and form pores between the ultrafine fibers, as well as a method for manufacturing the same.

Another object of the present invention is to provided a polishing pad with improved polishing performance and low occurrence of scratches during the polishing process, in which ultrafine fibers have high degree of freedom and are arranged at a wide range of raising angle $\theta_1$ on a surface of the polishing pad to allow smooth flow of a polishing slurry and reduce agglomeration of polishing particles in the slurry, as well as a method for manufacturing the same.

Technical Solution

In order to accomplish the above objects, the present invention provides a polishing pad comprising a non-woven fabric consisting of sea-island type composite fibers, each of which includes a sea component S containing easily soluble alkaline polyester copolymer as well as 10 to 1,000 island components I having a monofilament fineness of 0.001 to 0.3 denier and being dispersed in the sea component S, wherein at least 60% of ultrafine fibers in the non-woven fabric are regularly arranged at a relatively low orientation angle $\theta_2$ of 0 to 30° on a surface of the non-woven fabric.

Additionally, in order to accomplish the above objects, the present invention provides a polishing pad comprising a non-woven fabric consisting of ultrafine fibers and elastomeric polymer impregnated into the non-woven fabric, in which the ultrafine fibers are arranged and raised at relatively wide ranges of orientation angle $\theta_2$ and fiber raising angle $\theta_1$ on a surface of the non-woven fabric such that the ultrafine fibers formed on a surface of the polishing pad have increased degree of freedom to allow smooth flow of a polishing slurry and reduce agglomeration of polishing particles in the slurry, therefore, to decrease scratches occurring on a polished surface of a recording medium during a polishing process.

ADVANTAGEOUS EFFECTS

Compared to conventional polishing pads, the polishing pad of the present invention includes ultrafine fibers, which are arranged at a relatively wide orientation angle $\theta_2$ and have pores formed therebetween without requiring alternative processes for forming the pores, and thus, exhibits some advantages such as favorable surface uniformity, excellent polishing performance and low occurrence of scratches during a polishing process.

Moreover, the ultrafine fibers in the polishing pad of the present invention have increased degree of freedom and a wide range of fiber raising angle $\theta_1$ to allow smooth flow of a polishing slurry and reduce agglomeration of polishing particles in the slurry, thereby resulting in improved polishing performance and a decrease of scratches occurring on a polished surface of a recording medium.

DESCRIPTION OF DRAWINGS

The above objects, features and advantages of the present invention will become more apparent to those skilled in the related art in conjunction with the accompanying drawings. In the drawings.

DESCRIPTION OF SYMBOLS FOR MAJOR PARTS IN DRAWINGS

1: raised ultrafine fibers
2: ultrafine fibers arranged on surface of polishing pad
3: polishing pad
$\theta_1$: raising angle of ultrafine fiber
$\theta_2$: orientation angle of ultrafine fiber
S: sea component
I: island component
A: non-woven fabric impregnated with elastomeric polymer
B: elastomeric polymer layer

BEST MODE

Hereinafter, the present invention will be apparent from the following detailed description with reference to the accompanying drawings.

Figure 2:
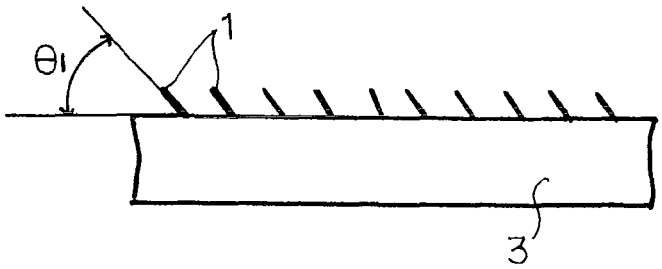
FIG. 2 is a schematic view illustrating a cross-section of the polishing pad according to the present invention.

First, a polishing pad of the present invention comprises a non-woven fabric consisting of ultrafine fibers, and elastomeric polymer impregnated into the non-woven fabric, on which the ultrafine fibers are raised and arranged as shown in FIG. 2 to simultaneously satisfy the conditions of following formulas (I) to (III) such that the ultrafine fibers are oriented in a longitudinal direction to a central axis:

$$(f_1+f_2) \geqq (f_1+f_2+f_3+f_4)/2 \quad \text{(I)}$$

$$f_2 > f_3 > f_4 \quad \text{(II)}$$

$$f_2 > f_1 \quad \text{(III)}$$

wherein, $f_1$ is total number of ultrafine fibers arranged at an orientation angle $\theta_2$ of 0 to less than 5° on a surface of the polishing pad, which has a certain unit area; $f_2$ is total number of ultrafine fibers arranged at an orientation angle $\theta_2$ of 5 to less than 30° on a surface of the polishing pad, which has a certain unit area; $f_3$ is total number of ultrafine fibers arranged at an orientation angle $\theta_2$ of 30 to less than 45° on a surface of the polishing pad, which has a certain unit area; and $f_4$ is total number of ultrafine fibers arranged at an orientation angle $\theta_2$ of 45 to 90° on a surface of the polishing pad, which has a certain unit area.

In the polishing pad of the present invention, at least 60% of the ultrafine fibers are preferably arranged at an orientation angle $\theta_2$ of 0 to 30° in a longitudinal direction of the non-woven fabric.

Figure 1:
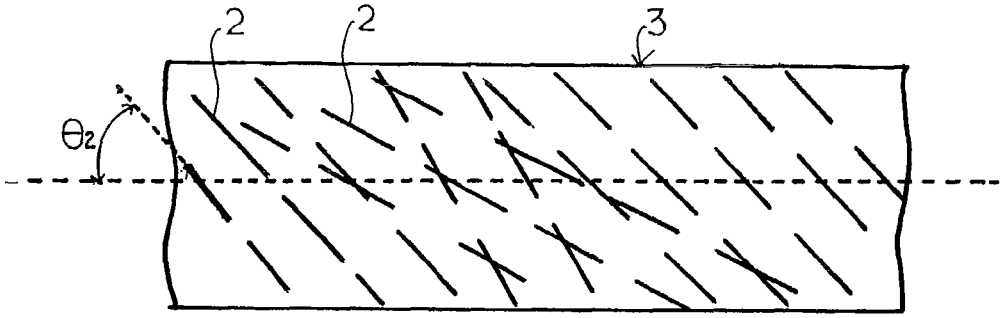
FIG. 1 is a schematic view illustrating a surface of a polishing pad according to the present invention.

FIG. 1 is a schematic view illustrating a surface of the polishing pad according to the present invention, representing a concept of the orientation angle $\theta_2$.

The orientation angle $\theta_2$ means an angle between a longitudinal axis of the ultrafine fibers arranged on the surface of the polishing pad and a longitudinal axis of the polishing pad.

As the orientation angle $\theta_2$ decreases, the fibers are more uniformly arranged on the surface of the polishing pad.

If the ultrafine fibers arranged at the orientation angle $\theta_2$ of 0 to 30° are less than 50% of the overall ultrafine fibers, the fibers are not uniformly arranged on the surface of the polishing pad, and thus, reduce polishing performance of the polishing pad while increasing occurrence of scratches during a polishing process. Consequently, the above range of orientation angle is not preferable.

The orientation angle $\theta_2$ of the ultrafine fibers 2 arranged on the surface of the polishing pad 3 is defined by an angle between a longitudinal central axis of the polishing pad and a straight line indicating a direction of orientating the ultrafine fibers 2.

If the conditions of above formulas (I) to (III) are not satisfied simultaneously, the ultrafine fibers arranged on the surface of the polishing pad show considerably reduced degree of freedom, possibly deterring the polishing slurry from smoothly flowing and causing agglomeration of polishing particles in the slurry during the polishing process.

The degree of freedom of the ultrafine fibers means an extent that the ultrafine fibers freely move without any spatial restrictions. The degree of freedom depends on arrangement of the fibers, that is, a fiber raising angle, an orientation angle, and strength of fixing the fibers. For example, if the fiber raising angle and/or the orientation angle is too small, the degree of freedom decreases. Conversely, with an excessively large fiber raising angle, the degree of freedom increases but the polishing pad shows decreased polishing efficiency. On the other hand, an excessively large orientation angle may adversely affect fluidity of a polishing solution while causing a decrease in the degree of freedom. Accordingly, the polishing pad must have a suitable fiber raising angle and orientation angle such that the polishing slurry smoothly flows during the polishing process and the agglomeration of the polishing particles in the slurry is considerably reduced. Also, even if agglomerated, the slurry can be smoothly output and/or rapidly be absorbed into the fabric.

The fiber raising angle $\theta_1$ and the orientation angle $\theta_2$ are measured by observing a scanning electron microscopy (SEM) image of a polishing pad.

As shown in FIG. 2, the polishing pad of the present invention has ultrafine fibers raised on the surface thereof.

FIG. 2 is a schematic view illustrating a cross-section of the polishing pad according to the present invention.

Referring to FIG. 2, the fiber raising angle $\theta_1$ is defined by an angle between a straight line drawn in the raising direction of ultrafine fibers 1 and another straight line drawn along the surface of the polishing pad.

At least 70% of the ultrafine fibers 1 raised on the surface of the polishing pad may have the desired fiber raising angle $\theta_1$ of 5 to 30°, which is preferable to improve fluidity of the polishing slurry.

The elastomeric polymer used in the polishing pad of the present invention may include polyurethane resin or polyurea resin and, more preferably, is polyurethane resin in view of processing ability.

The ultrafine fiber may include polyamide fiber or polyester fiber and, more preferably, is polyamide fiber in view of affinity to the polishing solution.

The ultrafine fiber may have a monofilament fineness in a range of 0.001 to 0.3 denier.

If the monofilament fineness is less than 0.001 denier, both strength of the ultrafine fiber and strength of the polishing pad may be decreased. On the other hand, if it exceeds 0.3 denier, the ultrafine fibers are arranged at an excessively large orientation angle $\theta_2$ on the surface of the polishing pad to make the surface irregular and slightly form pores between the ultrafine fibers, possibly causing decreases of polishing performance and polishing uniformity.

Next, a detailed description will be given of a method for manufacturing a polishing pad, especially, suitable for a CMP process according to the present invention.

Figure 3:
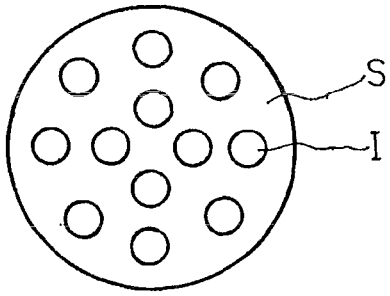
FIG. 3 is a cross-sectional view illustrating a sea-island type composite fiber used in manufacturing a polishing pad of the present invention.

Referring to FIG. 3, a non-woven fabric is produced by comprising sea-island type composite fibers, each of which includes a sea component S containing easily soluble alkaline polyester copolymer as well as 10 to 1,000 island components I having a monofilament fineness of 0.001 to 0.3 denier and being dispersed in the sea component S.

Following this, the non-woven fabric is impregnated with the elastomeric polymer, treated using an alkaline solution to extract the sea component S, followed by a buffing process to raise ultrafine fibers on a surface of the fabric, resulting in the proposed polishing pad.

FIG. 3 is a cross-sectional view illustrating the sea-island type composite fiber used in manufacturing the polishing pad of the present invention.

Alternatively, the present invention may produce a polishing pad by firstly treating the non-woven fabric already prepared as described above in an alkaline solution to extract the sea component S, then, impregnating the fabric with the elastomeric polymer.

The sea component S, that is, the easily soluble alkaline polyester copolymer includes polyethylene terephthalate as a base part and, additionally, at least one or more selected from a group consisting of polyethyleneglycol, polypropyleneglycol, 1,4-cyclohexane dicarboxylic acid, 1,4-cyclohexane dimethanol, 1,4-cyclohexane dicarboxylate, 2,2-dimethyl-1,3-propanediol, 2,2-dimethyl-1,4-butanediol, 2,2,4-trimethyl-1,3-propanediol and adipic acid, which has a molecular weight ranging from 400 to 20,000, more preferably, 1,000 to 4,000, and is prepared by copolymerizing the base part with the additional compound.

The elastomeric polymer may include polyurethane resin, polyurea resin, polyacrylic acid resin, etc. and, preferably, is polyurethane resin with respect to processing ability, abrasion resistance, hydrolysis resistance and the like.

A fiber base part preferably comprises the elastomeric polymer and ultrafine fibers in a ratio by weight ranging from 30:70 to 90:10.

If an amount of the elastomeric polymer is less than 30% by weight, hardness of the polishing pad is too low. When the amount of the elastomeric polymer exceeds 90% by weight, the polishing pad has excessively high hardness.

With regard to a process for charging the elastomeric polymer in the non-woven fabric, the elastomeric polymer in an organic solvent or an aqueous dispersion may be impregnated into the fabric and/or applied to the fabric, followed by a wet or a dry coagulation to complete adhesion of the elastomeric polymer to the non-woven fabric. However, the adhesion of the elastomeric polymer needs favorable uniformity sufficient to substantially charge elastomeric polymer in pores formed between bundles of fibers in the fabric. Also, the elastomeric polymer is preferably coagulated in a porous state so as to prevent defects such as slurry agglomeration and/or occurrence of scratches caused by polishing residue during the polishing process. Most preferably, the elastomeric polymer charging method may include the wet coagulation as the first process to charge the elastomeric polymer in the fabric and the dry coagulation as the second process to increase density of the elastomeric polymer.

The organic solvent used for dissolving the elastomeric polymer may include a polar solvent such as dimethylformamide, dimethylacetamide, dimethylsulfoxide, etc. and, additionally, toluene, acetone, methylethylketone and the like.

The polishing pad of the present invention has fibers raised on a polishing surface thereof.

The raising treatment of the polishing surface may be performed by any conventional method.

A polishing pad containing raised fibers on a polishing surface thereof is obtainable by charging elastomeric polymer in a non-woven fabric to prepare a pad A then carrying out a fiber raising treatment of the pad A. Herein, the pad A is preferably treated using an organic silicon compound to enhance the fiber raising effect. Such organic silicon compound is not particularly limited but may include any compound typically used to improve activity of fibers in conventional raising treatments of textile fabrics.

According to an aspect of the present invention, there is provided a method for manufacturing a polishing pad which comprises using ultrafine fibers with a monofilament fineness of 0.001 to 0.3 denier to prepare a non-woven fabric, impregnating the prepared fabric with high hardness elastomeric polymer and raising the fibers, compared to a conventional method that includes impregnating a normal non-woven fabric with polyurethane resin to prepare a pad A and attaching an additional polyurethane coating layer B, which contains pores, to the pad A.

As a result, the present invention can omit a step of forming the polyurethane coating layer B, thereby simplifying the process. Since the ultrafine fibers are arranged at a relatively wide orientation angle $\theta_2$ on the surface of the polishing pad, the present invention can easily achieve surface uniformity of the pad and controlled uniformity of microfine pores formed between the fibers.

An exemplary embodiment of the method for manufacturing a polishing pad, especially, suitable for texture processing a magnetic recording medium according to the present invention will be described in more detailed as follows.

First, a textile base such as a non-woven fabric is prepared using an elution type composite fiber comprising a fiber component and an eluted component or a split type composite fiber comprising two different fiber components. The textile base is then impregnated with elastomeric polymer and treated using a split or an elution type solution such as an alkaline solution to alter the composite fiber into ultrafine fibers. As a result, a sheet type product is produced, which consists of the textile base including the ultrafine fibers and is impregnated with the elastomeric polymer.

Alternatively, the treated non-woven fabric may be treated by the alkaline solution to alter the composite fiber into the ultrafine fibers before impregnating the fabric with the elastomeric polymer.

The elastomeric polymer includes polyurethane resin, polyurea resin, polyacrylic acid resin and the like and, preferably, is polyurethane resin with respect to processing ability, abrasion resistance and/or hydrolysis resistance.

The non-woven fabric preferably comprises the elastomeric polymer and ultrafine fibers in a ratio by weight ranging from 10:90 to 60:40.

If an amount of the elastomeric polymer is less than 10% by weight, the non-woven fabric shows no reinforcement effect and may have a lack of dimensional stability during the processing. When the amount of the elastomeric polymer exceeds 60% by weight, the non-woven fabric tends to exhibit poor adhesive condition of polishing abrasive particles and deteriorated removal of polishing residue.

The process for charging the elastomeric polymer in the non-woven fabric may include impregnating or coating the fabric with the elastomeric polymer in an organic solvent or an aqueous dispersion, followed by a wet or a dry coagulation to complete adhesion of the elastomeric polymer to the non-woven fabric. However, the adhesion of the elastomeric polymer needs favorable uniformity sufficient to substantially charge the elastomeric polymer in pores formed between bundles of fibers in the fabric. Also, the elastomeric polymer is preferably coagulated in a porous state so as to prevent defects such as slurry agglomeration and/or occurrence of scratches caused by the polishing particles. Therefore, a wet coagulation method is most preferably used to charge the elastomeric polymer in the fabric.

The organic solvent used for dissolving the elastomeric polymer may include a polar solvent such as dimethylformamide, dimethylacetamide, dimethylsulfoxide, etc. and, additionally, toluene, acetone, methylethylketone and the like.

The polishing pad of the present invention has fibers raised on a polishing surface thereof. The polishing pad is used to polish an object on the raised polishing surface so as to effectively form a uniform concentric groove on the object while considerably reducing abnormal trenches. The raising treatment may be performed by any conventional method known in the related art.

A polishing pad containing raised fibers on a polishing surface thereof is obtainable, for example, by charging elastomeric polymer in a non-woven fabric to prepare a composite fabric then carrying out a fiber raising treatment of the composite fabric. Herein, the composite fabric is preferably treated using an organic silicon compound to enhance fiber raising effect. Such organic silicon compound is not particularly limited but may include any compound typically used to improve activity of fibers in conventional fiber raising treatments of textile fabrics.

Following this, the sheet type product with a fiber raised surface is brushed in a forwarding direction of the pad, followed by a polyurethane setting process to complete the manufacture of a polishing pad according to the present invention.

The polyurethane setting process is performed by thermal treatment, resin treatment and/or solvent treatment.

The thermal treatment comprises treating the sheet by a dry heating or a heat calendering process at a high temperature ranging from 120 to 180° C. such that the sheet is securely combined with the raised fibers by polyurethane. The resin treatment comprises applying the elastomeric polymer such as polyurethane to the fiber raised surface of the sheet by gravure coating to form a thin film coating over the sheet, thereby setting the raised fibers. Lastly, the solvent treatment is performed by applying an organic solvent for the elastomeric polymer, for example, dimethylformamide to the surface of the sheet via spray or gravure coating to increase a binding ability of the elastomeric polymer, that is, polyurethane to the surface of the sheet, thereby securely setting the raised fibers. The polyurethane setting process may include any one of the above treatments alone or a combination of two or more thereof. The key point of the polyurethane setting process is to set polyurethane on the surface of the sheet and to fix the raised fibers arranged on the surface of the sheet at certain orientation angle and fiber raising angle on the surface of the sheet.

The polishing pad of the present invention exhibits increased degree of freedom of the ultrafine fibers arranged on the surface and has a wide range of fiber raising angle $\theta_1$ so as to allow smooth flow of a polishing slurry and reduce agglomeration of polishing particles in the slurry, thereby resulting in improved polishing performance and low occurrence of scratches during the polishing process.

The ultrafine fiber orientation angle $\theta_2$ is measured by the following method.

Taking a SEM image of the surface of a sample (the polishing pad), the image was processed by I-Solution software as an image analysis program available from IMT Technology Corp. (Korea) that sets 0° for a length direction of the polishing pad, determines angles of 100 raised fibers to a straight line parallel in a width direction of the polishing pad, and defines an average of the determined values as an orientation angle $\theta_2$ of the ultrafine fibers arranged on the surface of the polishing pad.

In this regard, the sample is prepared by making the fibers in the sample to be naturally arranged at original fiber raising angles and orientation angles thereof through vibration, and leaving the sample at 25° C. in a 65% relative humidity atmosphere for 24 hours.

For vibration of the sample, the sample is shaken 5 to 10 times by hand or is treated using a supersonic vibrator.

The length direction of the sample may be defined by a pin hole direction generated by tenter processing and/or a needle track direction generated by needle punching. If it is difficult to define the length direction by the above methods, the length direction may be determined by drawing straight lines in radial directions to divide the sample by 15° from any point on the sample, measuring orientation angles of 50 raised fibers on the surface of the sample, determining the angles with the smallest standard deviation in directions of the raised fibers, estimating an average of the determined orientation angles, and defining the average as the length direction of the sample.

Surface roughness of a polished silicon wafer and scratch occurrence thereon were determined by the following methods.

Average Surface Roughness of Silicon Wafer

One of confocal laser scanning microscopes (hereinafter referred to as "LSM"), LSM 5 PASCAL available from Carl Zeiss Corp. was used together with a software package for LSM topography to determine surface roughness of a silicon wafer.

In particular, the surface roughness of a polished silicon wafer is determined by treating a certain area of the polished silicon wafer (100 μm width×100 μm length) through laser scanning to represent trenches or unevenness existing on the surface of the wafer in a three-dimensional profile.

More particularly, the surface roughness Sa was determined from an arithmetic average of values measured at 10 points of the sample according to JIS B 0601.

Scratch Occurrence (%)

Polishing an area of 100 inch$^2$ of a silicon wafer or a disk substrate by a polishing pad and counting scratches generated on the area, a scratch occurrence was calculated from the counted number by the following equation:

$$\text{Scratch occurrence}(\%)=(\text{counted number of scratches}/100\text{inch}^2)\times 100$$

Wherein, provided that the number of scratches is defined as 100 where it is more than 100, i.e. the maximum number of scratches is 100.

The scratch is observed and determined by those skilled in the art through visible detection. For unclear parts having difficulty in visible detection, they may be determined by additional measurement methods using an optical microscope equipped with a dark field light and installed with image analysis software.

A trench or groove with a relative ratio of lengths in a length direction to a width direction of above 10:1 is considered as the scratch.

With regard to the present invention, the performance for polishing a disk substrate was evaluated on the basis of roughness of the disk substrate and disk production failure during a texturing process, both being determined by the following methods.

Surface Roughness of Disk Substrate 10 points were randomly selected from a surface of a disk substrate that has been subjected to a texturing process, followed by measurement of the surface roughness according to JIS B 0601. An average was calculated from the measured values.

The present invention will be more apparent from the following examples and comparative examples. However, these are intended to illustrate the invention as preferred embodiments of the present invention and do not limit the scope of the present invention.

Production of Polishing Pad for CMP Process

EXAMPLE 1

As shown in FIG. 1, a sea-island type composite fiber comprising an easily soluble alkaline polyester copolymer as a sea component S and 300 island components I based on polyester resin and being dispersed in the sea component S (a monofilament fineness for the island component I: 0.05 denier) was cut into staple fibers having a length of 50 mm. After carding and cross-lapper processing, the treated staple fibers were formed into a laminate web. The laminate web was subjected to a needle punching process, resulting in a non-woven fabric made of the sea-island type composite fiber.

Next, the produced fabric was impregnated with 40% by weight of polyurethane resin relative to total weight of the fabric, then, treated by a wet coagulation method. The coagulated fabric was treated using an alkaline solution (such as sodium hydroxide) to extract the sea component S, followed by a fiber raising treatment such that ultrafine fibers were raised on a surface of the fabric to produce the proposed polishing pad as a final product.

Among the total amount of ultrafine fibers arranged on the surface of the polishing pad, the ratio of ultrafine fibers having an orientation angle $\theta_2$ in a range of 0 to 30° was determined. The results are shown in TABLE 1.

Using the produced polishing pad, a silicon wafer with an area of 100 inch$^2$ was polished under the following conditions:

Polishing Conditions:

- Polisher: Poli-500 polisher available from GNP Technology Corp.
- Polishing time: 10 minutes
- Download force: 250 g/cm$^2$ (3.5 psi) at surface of wafer
- Speed of platen: 120 rpm
- Speed of wafer carrier: 120 rpm
- Flow rate of slurry: 700 ml/min
- Slurry type: Nalco 2371, silica based slurry diluted with DIW at a ratio of 1:15

The polished silicon wafer was subjected to measurement of average surface roughness and scratch occurrence. The results are shown in TABLE 1.

EXAMPLE 2

A polishing pad was produced by the same procedure as in Example 1 except that the non-woven fabric prepared in Example 1 was firstly treated using an alkaline solution to extract a sea component S from the composite fiber and impregnated with 40% by weight of polyurethane resin relative to total weight of the fabric, followed by a wet coagulation method. Using the produced polishing pad, a silicon wafer with an area of 100 $inch^2$ was polished by the same process as in Example 1.

Among the total amount of ultrafine fibers arranged on the surface of the polishing pad, the ratio of ultrafine fibers having an orientation angle $\theta_2$ in a range of 0 to 30° was determined. The results are shown in TABLE 1.

The polished silicon wafer was subjected to measurement of average surface roughness and scratch occurrence. The results are shown in TABLE 1.

COMPARATIVE EXAMPLE 1

Instead of the sea-island type composite fiber used in Example 1, polyamide staple fiber having a monofilament fineness of 3 denier was used. Carding and cross-lapper processing the polyamide fiber resulted in a laminate web, which in turn, was treated by a needle punching process to prepare a non-woven fabric.

The prepared non-woven fabric was impregnated with 40% by weight of polyurethane resin relative to total weight of the fabric, followed by a wet coagulation method and a buffing process, thereby producing a polishing pad A as a final product.

Among the total amount of ultrafine fibers arranged on the surface of the polishing pad, the ratio of ultrafine fibers having an orientation angle $\theta_2$ in a range of 0 to 30° was determined. The results are shown in TABLE 1.

Figure 4:
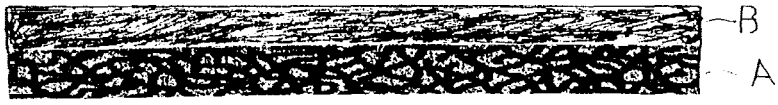
FIG. 4 is a schematic view illustrating a cross-section of a conventional polishing pad.

Next, applying polyurethane resin to the polishing pad A formed a coating layer B, which in turn, resulted in a polishing pad with a cross-sectional side view as shown in FIG. 4.

Using the resultant polishing pad, a silicon wafer with an area of 100 $inch^2$ was polished under the same conditions as in Example 1.

The polished silicon wafer was subjected to measurement of average surface roughness and scratch occurrence. The results are shown in TABLE 1.

Production of Polishing Pad in Disk Substrate for Texture Processing

EXAMPLE 3

An elution type composite fiber (a monofilament fineness for the polyamide fiber component: 0.05 denier) comprising an eluted component based on polyester copolymer, which reacts to divide a cross-section of a yarn into 32 segments, and a polyamide fiber component, which is divided by a slit component in the eluted component and has a cross-section in a triangle form, was cut into staple fibers having a length of 50 mm. After carding and cross-lapper processing, the treated staple fibers were formed into a laminate web. The laminate web was subjected to needling punching, resulting in a non-woven fabric made of the elution type composite fiber.

Next, the produced fabric was impregnated with 40% by weight of polyurethane resin relative to total weight of the fabric, then, treated by a wet coagulation method. The coagulated fabric was treated using an alkaline solution (such as sodium hydroxide) to obtain the eluted component from the composite fiber, followed by a fiber raising treatment such that ultrafine fibers were raised on a surface of the fabric to produce a sheet type product comprising the non-woven fabric made of ultrafine fibers and impregnated with elastomeric polymer.

After brushing in a forwarding direction, the sheet was subjected to a polyurethane setting process including thermal treatment, resin treatment and solvent treatment, thereby producing a polishing pad for texture processing as a final product.

Various surface properties of the produced polishing pad were evaluated. The results are shown in TABLE 1.

The polishing pad was fabricated into a tape having a width of 40 mm, which in turn, underwent a texturing process under the following conditions.

A disk was prepared by Ni—P plating an aluminum substrate then polishing the substrate. The disk was polished by loading a glass polishing particle slurry, which comprises diamond crystals having an average diameter of 0.1 μm, on the polishing pad then moving the polishing pad coated with the slurry to polish the disk at a tape running speed of 5 cm/min. After completion of the texturing process, five (5) disks were randomly selected to measure surface roughness. As a result of the measurement, it was found that the disks showed a surface roughness of 0.23 nm, 0.24 nm, 0.23 nm, 0.25 nm and 0.25 nm, respectively, all safely being within 0.3 nm. Scratch occurrence was 0.05% to demonstrate favorable processing ability.

EXAMPLE 4

A split type composite fiber comprising polyester based radial components, which have a cross-section divided into segments by slit components, was cut into staple fibers having a length of 50 mm. After carding and cross-lapper processing, the treated staple fibers were formed into a laminate web. The laminate web was subjected to a needle punching process, resulting in a non-woven fabric made of the split type composite fiber.

Next, the produced fabric was impregnated with 40% by weight of polyurethane resin relative to total weight of the fabric, then, treated by a wet coagulation method. The coagulated fabric was treated using an alkaline solution (such as sodium hydroxide) to obtain an eluted component from the composite fiber, followed by a fiber raising treatment such that ultrafine fibers were raised on a surface of the fabric to produce a sheet type product comprising the non-woven fabric made of ultrafine fibers and impregnated with elastomeric polymer.

After brushing in a forwarding direction, the sheet was subjected to a polyurethane setting process including thermal treatment, resin treatment and solvent treatment, thereby producing a polishing pad for texture processing as a final product.

Various surface properties of the produced polishing pad were evaluated. The results are shown in TABLE 1.

The polishing pad was fabricated into a tape having a width of 40 mm, which in turn, underwent a texturing process under the following conditions.

A disk was prepared by Ni—P plating an aluminum substrate then polishing the substrate. The disk was polished by loading a glass polishing particle slurry, which comprises diamond crystals having an average diameter of 0.1 μm, on the polishing pad then moving the polishing pad coated with the slurry to polish the disk at a tape running speed of 5 cm/min. After completion of the texturing process, five (5) disks were randomly selected to measure surface roughness. As a result of the measurement, it was found that the disks showed a surface roughness of 0.22 nm, 0.24 nm, 0.23 nm, 0.24 nm and 0.24 nm, respectively, all safely being within 0.3 nm. Scratch occurrence was 0.04% to demonstrate favorable processing ability.

COMPARATIVE EXAMPLE 2

The sheet prepared in Example 3 was used as a polishing pad for texture processing, without the polyurethane setting process.

Various surface properties of the polishing pad were evaluated. The results are shown in TABLE 1.

The polishing pad was fabricated into a tape having a width of 40 mm, which in turn, underwent a texturing process under the following conditions.

A disk was prepared by Ni—P plating an aluminum substrate then polishing the substrate. The disk was polished by loading a glass polishing particle slurry, which comprises diamond crystals having an average diameter of 0.1 μm, on the polishing pad then moving the polishing pad coated with the slurry to polish the disk at a tape running speed of 5 cm/min. After completion of the texturing process, five (5) disks were randomly selected to measure surface roughness. As a result of the measurement, it was found that the disks showed the surface roughness of 0.3 nm, 0.29 nm, 0.29 nm and 0.3 nm, respectively, all greater than those in Examples 3 and 4. Scratch occurrence was 1.7% higher than those in Examples 3 and 4.

COMPARATIVE EXAMPLE 3

The sheet prepared in Example 4 was used as a polishing pad for texture processing, without the polyurethane setting process.

Various surface properties of the polishing pad were evaluated. The results are shown in TABLE 1.

The polishing pad was fabricated into a tape having a width of 40 mm, which in turn, underwent a texturing process under the following conditions.

A disk was prepared by Ni—P plating an aluminum substrate then polishing the substrate. The disk was polished by loading a glass polishing particle slurry, which comprises diamond crystals having an average diameter of 0.1 μm, on the polishing pad then moving the polishing pad coated with the slurry to polish the disk at a tape running speed of 5 cm/min. After completion of the texturing process, five (5) disks were randomly selected to measure surface roughness. As a result of the measurement, it was found that the disks showed the surface roughness of 0.3 nm, 0.3 nm, 0.29 nm and 0.29 nm, respectively, all greater than those in Examples 3 and 4. Scratch occurrence was 1.8% higher than those in Examples 3 and 4.

TABLE 1

Evaluation results of surface properties of polishing pad

| Item | Ex. 1 | Ex. 2 | Ex. 3 | Ex. 4 | Comparative Ex. 1 | Comparative Ex. 2 | Comparative Ex. 3 |
|---|---|---|---|---|---|---|---|
| Total number of ultrafine fibers arranged at orientation angle $\theta_2$ of 0 to less than 5° on a surface of 100 μm [$f_1$] | 10 | 12 | 12 | 10 | 20 | 22 | 17 |
| Total number of ultrafine fibers arranged at orientation angle $\theta_2$ of 5 to less than 30° on a surface of 100 μm [$f_2$] | 17 | 20 | 21 | 18 | 13 | 14 | 12 |
| Total number of ultrafine fibers arranged at orientation angle $\theta_2$ of 30 to less than 45° on a surface of 100 μm [$f_3$] | 13 | 15 | 15 | 12 | 11 | 12 | 10 |
| Total number of ultrafine fibers arranged at orientation angle $\theta_2$ of 45 to 90° on a surface of 100 μm [$f_4$] | 6 | 7 | 5 | 8 | 5 | 3 | 8 |
| Ratio of ultrafine fibers raised at fiber raising angle $\theta_1$ of 5 to 30° on a surface of 100 μm (%) | 78 | 80 | 76 | 83 | 58 | 55 | 61 |
| Scratch occurrence (%) | 0.04 | 0.05 | 0.05 | 0.04 | 1.6 | 1.7 | 1.8 |
| Ratio of ultrafine fibers arranged at orientation angle $\theta_2$ of 0 to 30° on a surface (%) | 73 | 82 | 75 | 85 | 42 | 50 | 46 |

INDUSTRIAL APPLICABILITY

As is apparent from the description disclosed above, the present invention provides a polishing pad which is useful in CMP processes of silicon wafers and texture processing a magnetic recording medium.

While the present invention has been described with reference to the accompanying drawings, it will be understood by those skilled in the art that various modifications and variations may be made therein without departing from the scope of the present invention as defined by the appended claims.

The invention claimed is:

1. A polishing pad, comprising a non-woven fabric consisting of ultrafine fibers and elastomeric polymer impregnated into the fabric, on which the ultrafine fibers are raised and arranged to simultaneously satisfy the following conditions (I) to (III) such that the ultrafine fibers are oriented in a longitudinal direction to a central axis:

$$(f_1+f_2) \geqq (f_1+f_2+f_3+f_4)/2 \quad \text{(I)}$$

$$f_2 > f_3 > f_4 \quad \text{(II)}$$

$$f_2 > f_1 \quad \text{(III)}$$

wherein, $f_1$ is total number of ultrafine fibers arranged at an orientation angle $\theta_2$ of 0 to less than 5° on a surface of the polishing pad, which has a certain unit area; $f_2$ is total number of ultrafine fibers arranged at an orientation angle $\theta_2$ of 5 to less than 30° on a surface of the polishing pad, which has a certain unit area; $f_3$ is total number of ultrafine fibers arranged at an orientation angle $\theta_2$ of 30 to less than 45° on a surface of the polishing pad, which has a certain unit area; and $f_4$ is total number of ultrafine fibers arranged at an orientation angle $\theta_2$ of 45 to 90° on a surface of the polishing pad, which has a certain unit area.

2. The polishing pad according to claim 1, wherein at least 50% of the ultrafine fibers are arranged at an orientation angle $\theta_2$ of 0 to 30° in a longitudinal direction of the non-woven fabric.

3. The polishing pad according to claim 1, wherein at least 70% of the ultrafine fibers raised on the surface of the polishing pad have a fiber raising angle $\theta_1$ of 5 to 30°.

4. The polishing pad according to claim 1, wherein the ultrafine fibers have a monofilament fineness in a range of 0.001 to 0.3 denier.

5. The polishing pad according to claim 1, wherein the elastomeric polymer is any one selected from polyurethane resin and polyurea resin.

6. The polishing pad according to claim 1, wherein the ultrafine fibers consist of polyamide resin.

* * * * *